United States Patent [19]

Schlack

[11] Patent Number: 4,893,849

[45] Date of Patent: Jan. 16, 1990

[54] REMOTE LATCHING MECHANISM

[75] Inventor: Richard E. Schlack, Unionville, Pa.

[73] Assignee: Southco, Inc., Concordville, Pa.

[21] Appl. No.: 100,623

[22] Filed: Sep. 24, 1987

[51] Int. Cl.[4] ..... E05C 5/02

[52] U.S. Cl. ..... 292/7; 292/66

[58] Field of Search ..... 292/7, DIG. 60, DIG. 63, 292/DIG. 49, DIG. 5, 87, 64, 66, 110, 113

[56] References Cited

U.S. PATENT DOCUMENTS

| | | | |
|---|---|---|---|
| 2,017,564 | 10/1935 | Claud-Mantle | 292/64 X |
| 2,195,542 | 4/1940 | Shaffer et al. | 292/DIG. 49 X |
| 3,844,591 | 10/1974 | Velcover | 292/7 |
| 4,025,094 | 5/1977 | Mitchell | 292/87 |
| 4,182,539 | 1/1980 | Busch | 292/110 X |
| 4,230,351 | 10/1980 | Bisbing | 292/DIG. 49 X |
| 4,273,368 | 6/1981 | Tanaka | 292/53 |

FOREIGN PATENT DOCUMENTS

| | | | |
|---|---|---|---|
| 0022604 | 1/1981 | European Pat. Off. . | |
| 491723 | 9/1938 | United Kingdom | 292/110 |
| 2146693 | 4/1985 | United Kingdom . | |
| 2146694 | 4/1985 | United Kingdom . | |
| 2159870 | 12/1985 | United Kingdom . | |

OTHER PUBLICATIONS

EMKA Brochure for Stainless Three-way Latch System.

*Primary Examiner*—Richard E. Moore
*Attorney, Agent, or Firm*—Paul & Paul

[57] ABSTRACT

A remote compression-type latching mechanism is provided which comprises an actuator assembly, an elongate rod connected to the actuator assembly for lateral movement in response to actuation of the actuator assembly, a bracket, and a pawl disposed within the bracket and connected to a remote end of the rod for sliding and pivoting movement in response to movement of the rod. The movement of the pawl is guided and facilitated by slots within the bracket, which also provide positive over-center latching in a preferred embodiment. Upon pivoting to the latched position, the pawl contacts a frame to draw the closure member up against the frame under compression.

20 Claims, 3 Drawing Sheets

REMOTE LATCHING MECHANISM

BACKGROUND OF THE INVENTION

This invention relates to a latching mechanism for use in securing two relatively movable members together, such as a door or the like to a cabinet or frame. More particularly, the present invention relates to a remote latching mechanism, wherein the latching action of the mechanism occurs at a location remote from the latch actuating portion of the mechanism. More particularly, the present invention relates to a compression-type remote latching mechanism wherein the door or other closure member is held, under compression, tightly against the cabinet or like frame structure.

Many types of remote latching mechanisms are widely known and used in the art. A remote latching mechanism is defined generally as a latching mechanism in which the latching action occurs at a location remote from the latch actuator. A wellknown example of a remote latching mechanism is the type of latch mechanism used to secure an overhead garage door, wherein an actuator assembly, typically located at or near the center of the garage door, is connected to at least one latching bar which is horizontally disposed along the inside of the garage door. Upon actuation of the actuator assembly, typically by rotation of a T-shaped handle, the latching bar moves outwardly and is received in a detent in the frame for the garage door. Thus, the latching action, which occurs at the frame of the garage door, occurs at a location remote from the latch actuator.

Another well-known example of a remote latching mechanism can be found in lockers typically found in schools, gymnasiums and the like. The remote latching mechanism found on such lockers is similar to that used on garage doors and comprises an actuator handle assembly which, when moved upward, causes a bar or rod located inside the locker door to move out of latching detent in the top or bottom of the locker frame.

These examples of simple remote latching mechanisms function to prevent movement of the closure member relative to the frame and are examples of non-compression type remote latch mechanisms. A compression-type remote latch mechanism, to which the present invention relates, is defined as a remote latching mechanism which draws the door or other closure member tightly against the frame to compress a gasket disposed between the door and frame. Compression-type remote latching systems are typically used in those situations in which it is desirable or advantageous to prevent the exposure of sensitive machinery or electrical equipment to moisture, light or environmental contaminants.

A typical example of a known compression-type remote latch mechanism is EMKA Stainless Three-way Latch System, Nema-4 Sealed, which comprises an actuator assembly to which are connected a pair of angled rods or bars. At the remote ends of the angled rods is a roller assembly. A bracket, which guides the rod, is bolted to the inside of the door at an intermediate location. Upon placement of the door against the frame and actuation of the actuator assembly, the rods, guided by the brackets, move outwardly whereby the roller assemblies contact the frame. The door is then held under compression against the frame by the angle of bend in the rods and the radius of the roller assembly.

There are several known disadvantages with this type of remote latching system. First, the system requires rods with heavy cross-sections or special shapes in order to provide stiffness to reduce bending strains in the rod. These rods are either heavier or more costly to manufacture than straight, round rods. Second, the system is designed to have a fixed compression level. Thus, in order to increase the amount of compression, the amount of rod travel or rod displacement must be increased in addition to the use of a larger diameter roller assembly and a larger actuator assembly. Another known disadvantage is the need for brackets to guide the rods, which require some precision in their installation to ensure proper functioning of the system. All of these disadvantages negatively affect the overall cost and versatility of this type of remote latch mechanism.

SUMMARY OF THE INVENTION

I have invented a novel compression-type remote latching mechanism which overcomes the disadvantages of the known remote latching mechanisms described above. The remote latching mechanism of the present invention does not require bent rods or guiding brackets for the rods, is readily adjustable to provide variable compression and to accommodate variable door-gasket-frame dimensions, is easier and cheaper to install and manufacture, is lighter and more compact in design and, in a preferred embodiment, provides a positive over-center latching action.

Briefly, the present invention comprises a latch actuator assembly, which can be of any known type in structure and design; a bracket adapted for being affixed to the inside surface of the door, a pawl disposed within the bracket for sliding and pivoting movement relative thereto; and a latching rod, preferably straight, connected at one end to the actuator assembly at the other end to the pawl, wherein upon actuation of the actuator assembly, the latch rod moves to cause the pawl to slide relative to the bracket and then pivot to contact the frame and draw the door up tightly against the frame. In the preferred embodiments, the rod end is connected to the pawl by a link which passes over-center upon the pivoting of the pawl to the latched position.

Accordingly, it is a primary object of the invention to provide a novel compression-type remote latching mechanism.

It is another object of the invention to provide a remote latching mechanism which does not require heavy or specially shaped rods.

It is another object of the invention to provide a remote latching mechanism which utilizes a sliding and pivoting pawl to exert compressive latching action.

It is still another object of the invention to provide a remote latching mechanism wherein the amount of compression exerted can be readily changed without the need to alter the amount of rod travel.

It is still another object of the invention to provide a remote latching mechanism which is readily usable with varying door-gasket-frame dimensions.

It is a further object of the invention to provide a remote latching mechanism which offers positive over-center latching action to prevent accidental unlatching.

These and other objects of the invention will become apparent to one skilled in the art upon a further reading of the specification, including the detailed description of the embodiments with reference to the drawings and the appended claims.

DETAILED DESCRIPTION OF THE EMBODIMENTS

Figure 2:
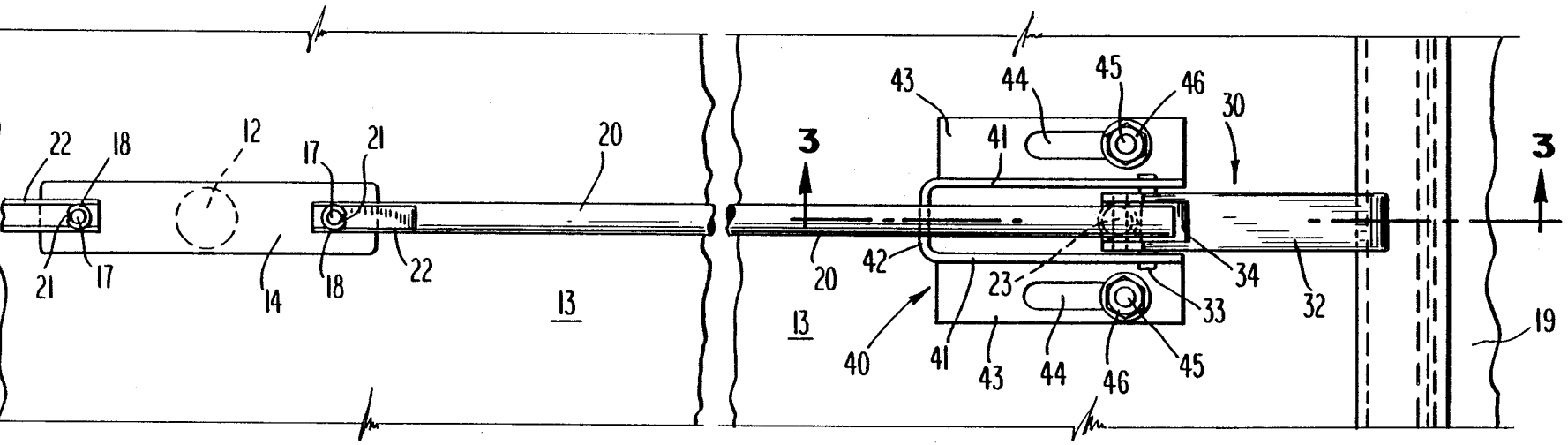
FIG. 2 is a side elevational view, partially fragmented, of the embodiment of FIG. 1 as seen along the lines and arrows 2—2 of FIG. 1.

With reference first being made to the embodiment of the present invention illustrated in FIGS. 1-5, the invention basically comprises an actuator assembly, at least one latching rod, at least one pawl, and at least one bracket for mounting the pawl.

The actuator assembly, designated generally at 10, may be of any known type which will impart the desired movement to the latching rods, as hereinafter described. In the embodiment illustrated in FIGS. 1 and 2, the actuator assembly 10 comprises a handle 11 affixed to a shaft 12 which shaft 12 is disposed through door 13 and terminates in a member 14. The actuator assembly 10 is affixed to door 13 by a collar 15 and nut 16 whereby the shaft 12 will rotate relative to the door 13 upon rotation of the handle 11. It is to be understood that upon rotation of handle 11, shaft 12 will rotate which, in turn, will cause the rotation of member 14 in a like direction and degree as the rotation of handle 11.

Figure 1:
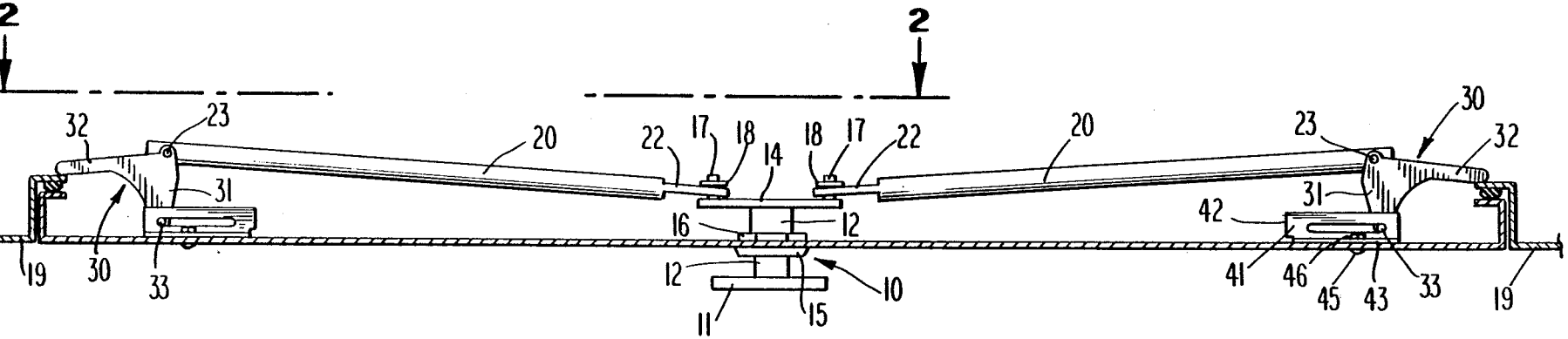
FIG. 1 is a plan view of one embodiment of the present invention, fully assembled in a typical door and frame installation and in the fully, latched position.

As seen in FIGS. 1 and 2, member 14 of actuator assembly 10 is provided with a pair of substantially cylindrical stud-like projections 17 which are disposed through an aperture 21 at the terminal end 22 of latching rods 20. Retaining clips 18 are provided to prevent the terminal end 22 of latching rods 20 from being disengaged from the studs 17. In this arrangement, latching rods 20 are permitted to pivot relative to member 14 when member 14 is rotated, thereby permitting latching rods 20 to slide back and forth in response to the rotation of member 14, the significance of which will be described below.

Latching rod 20 as perhaps best seen in FIG. 1, is a solid, substantially cylindrical elongate member having a terminal end 22 which is of a substantially flattened configuration to form a tab-like extension of latching rods 20. The opposite end of latching rods 20, that is the end remote from the terminal end 22, is affixed to a pawl member 30 by a transverse pin or the like 23 disposed through the pawl 30 and the latching rod 20. It is preferable for the latching rods 20 to be substantially straight, as shown, in that bent rods exhibit a tendency to buckle when subjected to stress. It is to be understood, however, that suitably bent or angled rods may be used, if desired, without any negative effect on the operation of the present invention.

Figure 3A:
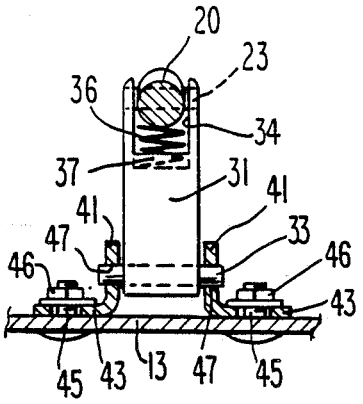
FIG. 3A is a cross-sectional view of the rod, pawl and bracket taken along lines and arrows 3A—3A of FIG. 3.

The pawl 30, in the embodiment illustrated in FIGS. 1-5, is an irregular-shaped member having a base portion 31 and a latching extension 32. Transversely disposed through the lower end of base portion 31 of pawl 30 is a pin 33 whose ends extend beyond the sides of pawl 30. (See FIG. 3A) The pin 33, as will be described more fully below, functions as a means for guiding and pivoting the pawl 30 in response to movement of the latching rod 20.

Latching rods 20, as described above, are connected to pawls 30 by a transverse pin 23. To accommodate the latching rod 20 and to impart the desired transition of movement from latching rod 20 to pawl 30, a substantially L-shaped cavity 34 is provided at the outer surface of the pawl. (See FIGS. 2-5) The L-shape of cavity 34 provides a shoulder 35 which is disposed below the latching rod 20 in the view illustrated in the Figures. As will be described more fully below, the shoulder 35 functions as a stop to limit the pivotal movement of the pawl 30 when the latching rod and pawl are moved to an unlatched position.

Figure 3:
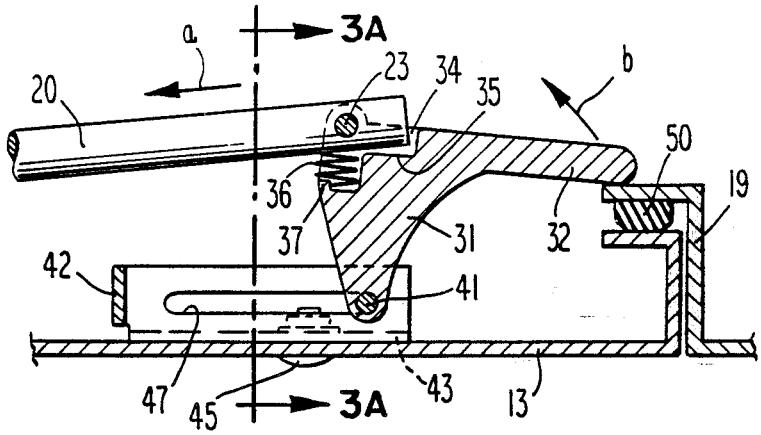
FIG. 3 is a sectional view of the pawl, taken along lines and arrows 3—3 of FIG. 2, illustrating the initial movement of the rod and pawl out of the latched position.
Figure 4:
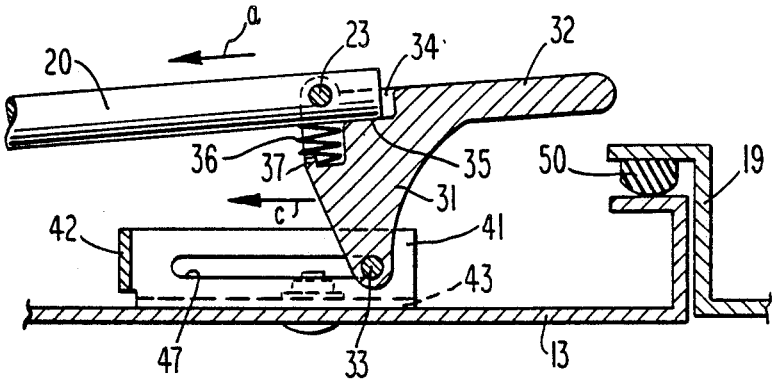
FIG. 4 is a sectional view of the pawl, similar to that of FIG. 3, illustrating the pawl in the unlatched position and further illustrating the sliding movement of the rod and pawl toward the fully retracted position.
Figure 5:
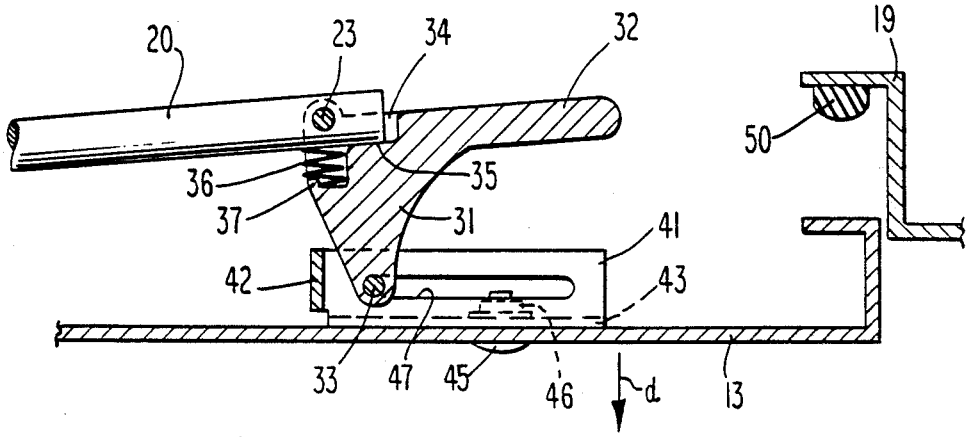
FIG. 5 is a sectional view of the pawl, similar to that of FIGS. 3 and 4 illustrating the rod and pawl in the fully retracted position.

As seen in FIGS. 3-5, a spring 36 is provided and is disposed within cavity 34 and retained therein by a lip protrusion 37 on the lower outer edge of the cavity. Coil spring 36 is positioned to contact latching rod 20 and to bias against the pivoting of pawl 30 into the latched position. (Compare FIGS. 3 and 4) The spring bias provides a positive "feel" to the mechanism and helps prevent slight erratic movements of the pawl during movement.

The pawl 30 is disposed within a bracket 40 of substantially elongate U-shaped construction having side walls 41 and a back wall 42. Side walls 41, at their lower edge, are bent outwardly to form mounting flanges 43, which mounting flanges 43 are provided with slotted mounting apertures 44 which facilitate the mounting of bracket 40 to the door 13, such as by the use of screws 45 and nuts 46 or other suitable fasteners (See FIG. 3A) Slotted apertures are preferred because they allow for adjustment of the bracket toward or away from the edge of the door 13, the significance of which is explained hereinbelow. For the same reason, releasable fasteners, such as screws and nuts are preferred over a more permanent fastener, such as a rivet.

The side walls 41 of bracket 40 are each provided with a slot 47 which are of such size and location to receive therein the ends of pin 33 (See FIG. 3A) which permit the sliding and pivoting of the pawl 30 relative to the bracket 40 in response to movement of the latching rod 20, as will now be described in detail with particular reference to FIGS. 3-5.

In the view illustrated in FIG. 3, the latching mechanism is in the fully latched position wherein the latching extension 32 of pawl 30 is in contact with frame 19 and the door 13 is pulled up tightly against the frame to compress the gasket 50. The pin 33 is disposed at the end of slot 47, the latching rod 20 is in an extended position, the pawl 30 is in a forward and downward orientation and the spring 36 is compressed between the pawl 30 and the latching rod 20. From this fully latched position, the actuator assembly 10 (See FIGS. 1 and 2) can be rotated whereby latching rod 20 will be pulled leftward from the position shown in FIG. 3 in the direction of arrow "a" in FIG. 3. Upon the movement of latching rod 20 in the direction of arrow "a", the pawl 30 will pivot and rotate in the counterclockwise direction illustrated by arrow "b" in FIG. 3. The counterclockwise rotation of pawl 30 will cause latching extension 32 to be released from contact with frame 19 and the pawl 30 will be in the position illustrated in FIG. 4, wherein the shoulder 35 is in contact with latching rod 20 to prevent any further rotation of pawl 30.

From the unlatched position illustrated in FIG. 4, further rotation of the actuator assembly will cause latching rod 20 to move further in the direction of arrow "a" of FIG. 4 which will cause pawl 30 to move in the direction of arrow "c" of FIG. 4 due to the sliding of pin 33 within slots 47 in side walls 41 of bracket 40. Upon completion of the rotation of the actuator assembly, the latching mechanism will be in the fully retracted position illustrated in FIG. 5 and the door 13 can be removed or opened as illustrated by arrow "d" of FIG. 5.

The latching of the mechanism from the fully retracted position of FIG. 5 to the latched position of FIG. 3 will be the exact opposite of that just described; that is, the actuation of the actuator assembly will cause latching rod 20 to move rightwardly which, in turn, will cause pawl 30 to slide rightwardly relative to the bracket 40. When pin 33 reaches the end of slot 47, further movement of latching rod 20 will cause pawl 30 to pivot in the clockwise direction about pin 33, whereby latching extension 32 of pawl 30 will contact frame 19 and door 13 will be pulled toward frame 19 to compress gasket 50.

The purpose of having slotted mounting apertures and releasable fasteners is to provide adjustability to the positioning of bracket 40 relative to the edge of door 13. By changing the distance between the bracket 40 and the edge of door 13, the point at which the pawl 30 begins to pivot as opposed to sliding can be altered which, in turn, will change the amount of compression exerted by the latch mechanism. For example, if a lesser amount of compression is desired, the bracket can be moved closer to the edge of the door which will delay the point at which the pawl begins to pivot. By delaying the pivoting movement of the pawl, a greater portion of the movement of the latching rod is used to slide the pawl and less of the rod movement is used to pivot the pawl. Thus, by moving the bracket closer to the edge of the door, the degree of rotation of the pawl is also reduced and the pawl will not provide as much compression as would otherwise be the case. The converse is true in the event that the bracket is moved farther away from the edge of the door, which will increase the amount of compression provided by the mechanism.

With reference now being made to FIGS. 6–9, the preferred embodiment of the invention will now be described. As seen in FIGS. 6–9, the preferred embodiment of the present invention comprises a rod 120 which is affixed to pawl 130 which pawl 130 is affixed to bracket 140, in similar relation to the alternate embodiments discussed above. The actuator assembly 10 and its connection to rod or rods 120 remains unchanged from the previously discussed embodiments and, therefore, is not illustrated in FIGS. 6–9. The rod 120 is provided with a bullet-shaped cap 121 at the terminal end thereof which cap moves with rod 120 when the mechanism is actuated. A transverse pin 122 is provided through the cap 121 near the rounded end thereof (See FIG. 9). The pin 122 comprises means for pivotally mounting a pair of link members 123 OD opposite sides of Cap 121 (See FIG. 9). Link members 123 are also pivotally connected to pawl 130 by a pin 124 or the like transversely disposed through pawl 130, whereby movement of rod 120 will impart movement to pawl 130. The significance of link members 123 will be discussed below in connection with the operation of this embodiment of the invention.

Pawl 130, as seen in the Figures, is of substantially S-shaped configuration, having a head portion 131, a body portion 132 and an elongate tail portion 133. The terminal end of tail portion 133 is provided with a transverse abutment 134, which serves to guide and pivot the pawl 130 in bracket 140 during operation of the latch mechanism. The transverse abutment 134 may be a single pin disposed through the tail portion 133 or it may be a pair of short cylindrical members affixed to either side of tail portion 133.

Head portion 131 of pawl 130 is provided with an adjustable stop member 135 which is adapted to engage frame 19 when the pawl 130 is pivoted to a latched position. (See FIG. 8) The adjustability of the stop member, although not necessary to the invention, is preferred because it facilitates the ready adaptation of the latch mechanism to varying frame-gasket-door dimensions and further facilitates the adjustment of the compressive force exerted by the latch mechanism on the gasket 50.

As also seen in the Figures, a bracket 140 is provided to secure the pawl 130 in proper position. Bracket 140 comprises an elongated substantially U-shaped member having a pair of side walls 141 and a back wall 142, the front of bracket 140 being open. Side walls 141 are provided with an elevated forward section **141*a* to accommodate the link members 123 and pin connections 122,124 and a lower rear section 141*b*. Flanges 143 are also provided for side walls 141 and are disposed substantially perpendicular thereto. Flanges 143 are provided with mounting apertures, such as slots 144, to facilitate the mounting of bracket 140 to the inside surface of door 13 such as by screws 145 or like fasteners. As in the previous embodiments, mounting apertures 144 are preferably slots to facilitate the adjustment of bracket 140 relative to the edge of door 13, although it is to be understood that bracket 140 may also be permanently affixed to door 13**, such as by welding, if desired.

Figure 6:
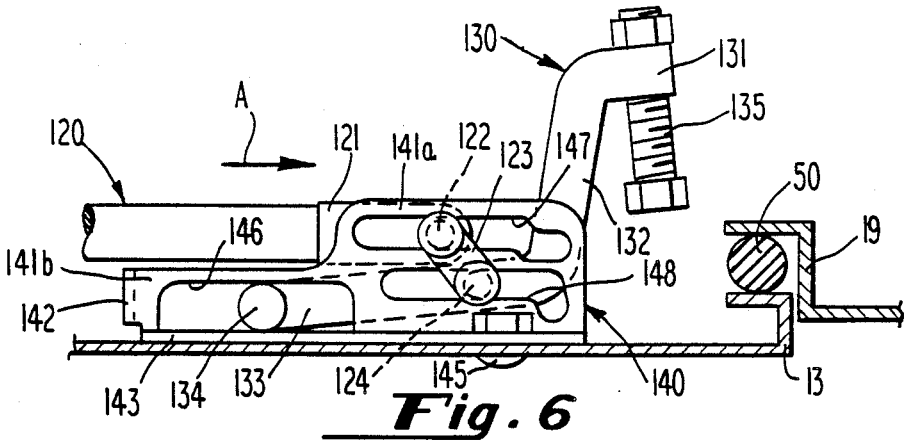
FIG. 6 is a sectional view, similar to that of FIGS. 3-5, of a preferred embodiment of the invention, illustrating the latch in an unlatched condition.
Figure 7:
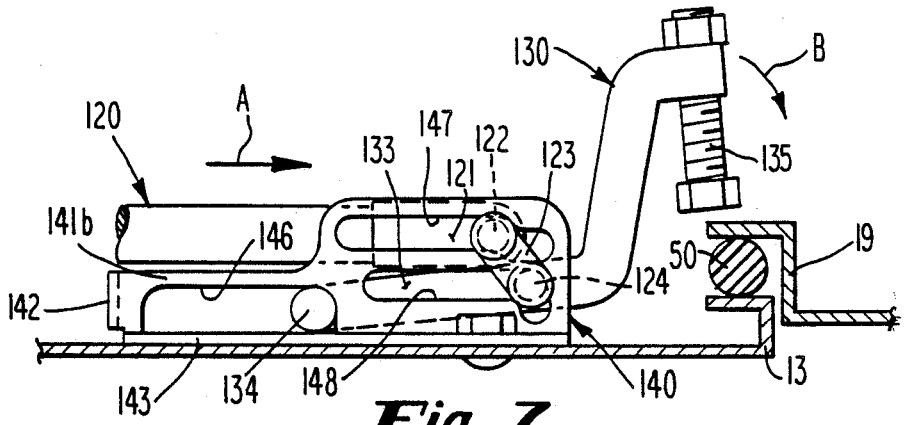
FIGS. 7 and 8 are sectional views of a preferred embodiment of the invention, similar to FIG. 6, illustrating the progressive movement of the latch from the unlatched position to a fully latched position as in FIG. 8.
Figure 8:
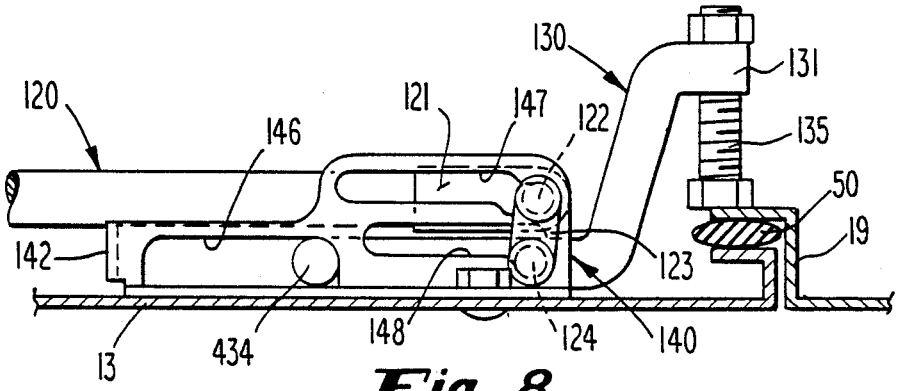
Figure 9:
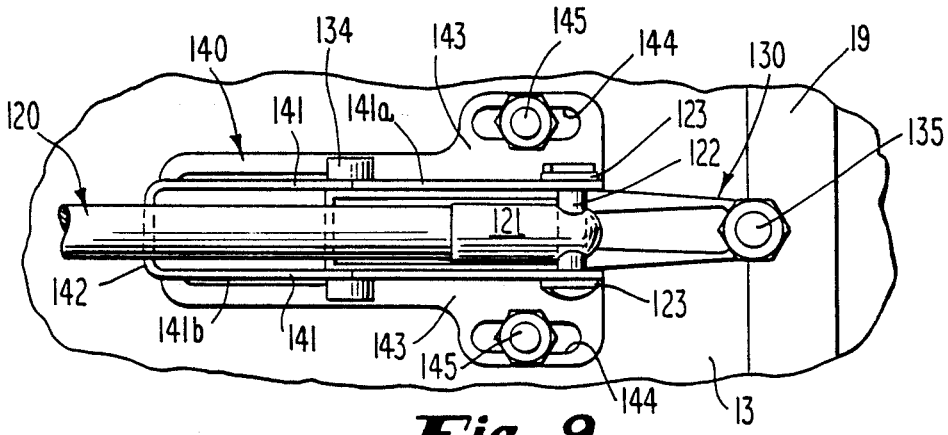
FIG. 9 is a side elevational view, similar to that of FIG. 2, of the preferred embodiment of the invention.

The rear section **141*b* of side walls 141 are provided with slots 146 which are adapted to receive abutments 134 therein and are sized to permit the sliding of pawl 130 in response to movement of rods 120. The forward section 141*a* of side walls 141 of bracket 140 is provided with two pairs of slots disposed one above the other. The uppermost pair of slots 147 are adapted to receive therein pin 122 which connects the cap 121 to the link members 123. The lower pair of slots 148 are adapted to receive therein the pin connection 124 between the link members 123 and the pawl 130. Slots 147,148 serve to guide the pawl 130 as it moves relative to bracket 140 in response to movement of the rod 120 when the mechanism is actuated. The forwardmost portion of slots 147,148, as seen in FIGS. 6–8, is bent to comprise a detent feature when the pawl 130** is moved to its latched position. This and other features of the preferred embodiment will now be described with respect to the operation of the latch.

From the retracted position illustrated in FIG. 6, actuation of the actuator assembly will cause rods 120 to move outwardly toward the edge of door 13 in the direction of arrow "A". The caps 121, being connected to rods 120, will move in like direction and amount which, in turn, will cause pawl 130 to slide within bracket 140 toward frame 19 through link members 123 and pin connections 122 and 124. Pins 122,124 disposed within slots 147,148, respectively, and transverse abutment 134 disposed within slots 146, insure the proper orientation and sliding movement of the pawl 130 and the rod 120.

The pawl 130 continues to slide in the direction of arrow "A" until it reaches the position illustrated in FIG. 7, wherein upon further movement of rods 120 and caps 121 in the direction of arrow "A", pawl 130 will pivot in the clockwise direction of arrow "B" in FIG. 7. The pivoting of pawl 130 at this point is facilitated by the transverse abutment 134 being disposed at the forwardmost end (the right-hand end in the view illustrated in the Figures) of slots 146 which prevents pawl 130 from any further sliding movement. This pivoting movement of pawl 130 is further facilitated by the bends in slots 147,148 which cause pins 122,124 to drop towards the inside surface of door 13 which, in turn, causes tail portion 133 of pawl 130 to likewise drop toward door 13 through link members 123.

Upon further movement of rods 120 and caps 121, the pawl 130 will be further pivoted into the fully latched position illustrated in FIG. 8, wherein stop member 135 contacts frame 19 and draws door 13 inward to compress gasket 50. As also seen in FIG. 8, pin connections 122,124 are fully seated in the forwardmost ends of slots 147,148 and pin 122 is disposed slightly forward of pin 124 which causes link members 123 to change from a leftward slanting orientation (See FIG. 7) to a rightward slanting orientation (See FIG. 8). In the orientation illustrated in FIG. 8, pin 122 has passed the vertical center of pin 124 to provide positive over-center latching of pawl 130.

As can be seen from FIG. 8, the amount of compressive force exerted by the pawl 130 can be readily altered by vertically adjusting the stop member 135. Downward adjustment of stop member 135 will cause an increase in the compressive force exerted and upward adjustment will decrease the compressive force. Furthermore, the adjustability of stop member 135 facilitates the use of a thicker gasket, if desired, and also facilitates the use of the latching mechanism on frames of varying depth dimensions.

The unlatching of the latch mechanism from the position illustrated in FIG. 8 to the position illustrated in FIG. 6 is the same as the latching operation just described, but in reverse. That is, upon movement of rods 120 and caps 121 in the leftward direction, links 123 will again assume their leftward slanting orientation, pawl 130 will be pivoted in the counterclockwise direction out of contact with frame 19 and will then be slid leftwardly away from the edge of door 13, and door 13 can be removed from frame 19.

Although the invention hereinabove described is designed to exert a compressive force between a door-and-frame or like structural members, it will be readily apparent to one skilled in the art that the present invention may be adjusted so as to not exert any appreciable compressive force, but may nevertheless be effective in securing the door immovable with respect to the frame. Therefore, although the present invention is intended for use in compressive applications, the exertion of an appreciable compressive force is not to be taken as a limitation on the invention herein described.

The above description and the views depicted in the Figures are for purposes of illustration only and are not intended to be and should not be construed as limitations on the invention. In particular and without limitation, terms such as left, right, down, up, clockwise, counterclockwise, etc. and derivatives thereof have been used for purposes of clarity in describing the invention only and it is to be understood that particular orientations will depend upon the use of the invention in a particular circumstance. Moreover, particular shapes, configurations and components have been described herein, but certain modifications or alternatives may suggest themselves to those skilled in the art upon reading of this specification, all of which are intended to be within the spirit and scope of the present invention as defined in the appended claims.

What is claimed is:

1. A remote latching mechanism comprising:

(a) an actuator assembly;

(b) at least one elongate rod affixed to said actuator assembly for lateral movement in response to actuation of said assembly;

(c) a bracket; and (d) a pawl connected to said rod at a location remote from said actuator assembly and disposed within said bracket for sliding and pivoting movement in response to the lateral movement of said rod; wherein said bracket comprises a pair of opposing side walls and a back wall connected to said side walls, wherein said pair of side walls is each provided with a longitudinal slot therein and a flange connected thereto, said flanges comprising means for mounting said bracket to a closure member, and wherein said slots comprise means for facilitating the guiding and pivoting of said pawl.

2. The latching mechanism of claim 1, wherein said pawl comprises an irregular-shaped member having a base portion and a latching extension connected to said base portion, said base portion having a transverse pin disposed therethrough and disposed within said slots in said bracket, said pin and said slots comprising means for guiding and pivoting said pawl, and wherein said latching extension is adapted to engage a frame for a closure member upon pivoting of said pawl into a latched position.

3. The latching mechanism of claim 1, further comprising biasing means disposed between said pawl and said rod for biasing against the pivoting of said pawl into a latched position.

4. The latching mechanism of claim 3, wherein said biasing means comprises a coil spring.

5. The latching mechanism of claim 1, wherein said side walls of said bracket comprise a rear section having said longitudinal slot therein, and an elevated forward section having a pair of substantially parallel longitudinal slots therein, and wherein said slots in said side walls comprise means for facilitating the guiding and pivoting of said pawl.

6. The latching mechanism of claim 5, wherein said pawl comprises a substantially S-shaped member having a head portion, a body portion and an elongate tail portion, said tail portion terminating in a transverse abutment disposed within said slots in said rear section of said bracket and cooperating therewith to comprise means for guiding and pivoting of said pawl.

7. The latching mechanism of claim 6, further comprising a pair of link members pivotally connected at one end to said rod by a first transverse pin and pivotally connected at another end to said pawl by a second transverse pin, said first transverse pin being disposed within an upper pair of slots in said elevated section of said bracket and said second transverse pin being disposed within a lower pair of slots within said elevated section of said bracket, wherein said link members and said transverse pins comprise means for imparting sliding and pivoting movement to said pawl in response to the lateral movement of said rod.

8. The latching mechanism of claim 7, wherein said first transverse pin is disposed closer to a forward edge of said elevated section than said second transverse pin when said pawl is in a latched position, thereby comprising over-center means for retaining said pawl in said latched position.

9. The latching mechanism of claim 6, wherein said head portion of said pawl is provided with a stop member adapted to engage a frame for a closure member when the pawl is pivoted into a latched position.

10. The latching mechanism of claim 9, wherein said stop member is vertically adjustable relative to said head portion.

11. A remote latching mechanism for use in securing a closure member to a frame, said latching mechanism comprising:

(a) an actuator assembly:

(b) at least one elongate rod connected to said actuator assembly for lateral movement in response to actuation of said assembly;

(c) a bracket adapted for being affixed to an inside surface of a closure member, said bracket having a pair of opposing side walls with at least one longitudinal slot in each of said side walls; and (d) a pawl disposed within said slots in said bracket and pivotally connected to said rod at a location remote from said actuator assembly, said pawl being slidably and pivotally movable between latched and unlatched positions in response to said lateral movement of said rod, wherein said pawl is adapted to contact a frame for a closure member when in the latched position.

12. The latching mechanism of claim 11, wherein said bracket has a single pair of slots in the side walls thereof, wherein said pawl comprises an irregular-shaped member having a base portion and a latching extension connected to said base portion, and wherein said latching extension is adapted to engage a frame for a closure member upon pivoting said pawl into said latched position.

13. The latching mechanism of claim 12, wherein said pawl is connected to said bracket by a transverse pin disposed through said base portion and within said slots, wherein said transverse pin and said slots comprise means for guiding and pivoting said pawl.

14. The latching mechanism of claim 12, further comprising spring means disposed between said pawl and said rod for biasing against the pivoting o said pawl into the latched position.

15. The latching mechanism of claim 11, wherein said sidewalls of said bracket comprise a rear section having one pair of slots and an elevated forward section adjacent said rear section having two pairs of slots disposed substantially parallel to one another, and wherein said pawl comprises a substantially S-shaped member having a head portion, a body portion and an elongate tail portion, said tail portion terminating in a transverse abutment, said transverse abutment being disposed within said slots in said rear section of said bracket wherein said slots in said rear section and said transverse abutment comprise means for guiding and pivoting said pawl.

16. The latching mechanism of claim 15, further comprising a pair of link members connected at one end to said rod by a first transverse pin disposed within an upper pair of slots in said elevated portion of said bracket and connected at another end to said pawl by a second transverse pin disposed within a lower pair of slots in said elevated portion of said bracket, wherein said link members and said transverse pins comprising means for imparting sliding and pivoting movement to said pawl in response to the lateral movement of said rod.

17. The latching mechanism of claim 16, wherein said first transverse pin is disposed closer to a forward edge of said elevated section of said bracket than said second transverse pin when said pawl is in the latched position, thereby comprising over-center means for retaining said pawl in said latched position.

18. The latching mechanism of claim 15, wherein said head portion of said pawl is provided with a stop member adapted to engage a frame for a closure member when the pawl is pivoted into a latched position.

19. The latching mechanism of claim 18, wherein said stop member is vertically adjustable relative to said head portion.

20. A remote compressive latching mechanism for use in securing a closure member to a frame under compression, said latching mechanism comprising:

(a) an actuator assembly adapted for being affixed to a closure member;

(b) at least one elongate rod connected to said actuator assembly for lateral movement in response to actuation of said actuator assembly, said rod being adapted for being disposed along an inside surface of a closure member when the actuator assembly is affixed to a closure member;

(c) a bracket structured for being adjustably mounted to an inside surface of a closure member, said bracket comprising:

(1) a pair of opposing side walls connected together by a back wall;

(2) said side walls having a rear section and an elevated forward section adjacent said rear section;

(3) said rear section of each of said side walls having a longitudinal slot therein;

(4) said elevated forward section of each of said side walls having a pair of substantially parallel slots therein disposed one above the other;

(5) said pair of slots in said elevated section being bent at a forwardmost end thereof;

(d) a substantially S-shaped pawl connected to said rod at a location remote from said actuator assembly by a first transverse pin disposed through said rod and engaging an upper pair of slots in said elevated section of said bracket, a second transverse pin disposed through said pawl and engaging a lower set of slots in said elevated section of said bracket, and a pair of link members connected to said first and second transverse pins, wherein said pawl comprises:

(1) a head portion;

(2) an adjustable stop member connected to said head portion and adapted to engage a frame of a closure member when said pawl is in a latched position;

(3) a body portion adjacent said head portion;

(4) an elongate tail portion adjacent said body portion, said tail portion terminating in a transverse abutment which engages said slots in said rear section of said bracket; wherein said pawl is slidably and pivotally movable between latched and unlatched positions in response to said lateral movement of said rod;

(e) wherein said slots in said bracket, said first and second transverse pins and said transverse abutment comprise means for guiding and pivoting said pawl; and (f) wherein said first transverse pin is closer to a forward edge of said bracket than said second transverse pin when said pawl is in a latched position, thereby comprising over-center means for retaining said pawl into said latched position.

* * * * *

UNITED STATES PATENT AND TRADEMARK OFFICE

CERTIFICATE OF CORRECTION

PATENT NO. : 4,893,849

DATED : January 16, 1990

INVENTOR(S) : Richard E. Schlack

It is certified that error appears in the above-identified patent and that said Letters Patent is hereby corrected as shown below:

Col. 6, line 6, "OD" should be --on--.
Col. 9, line 62, delete "o" and add therefor -- of --.

Signed and Sealed this

Fifth Day of February, 1991

*Attest:*

HARRY F. MANBECK, JR.

*Attesting Officer*

*Commissioner of Patents and Trademarks*